United States Patent [19]

Gruner et al.

[11] 4,154,604

[45] May 15, 1979

[54] FEEDING ADDITIVES INTO THE INTERIOR OF MOLTEN METAL

[75] Inventors: Hans Gruner; Hans Schrewe, both of Duisburg; Fritz P. Pleschiutschnigg, Düsseldorf, all of Fed. Rep. of Germany

[73] Assignee: Mannesmann Aktiengesellschaft, Düsseldorf, Fed. Rep. of Germany

[21] Appl. No.: 817,739

[22] Filed: Jul. 21, 1977

[30] Foreign Application Priority Data

Jul. 28, 1976 [DE] Fed. Rep. of Germany ..... 2634282

[51] Int. Cl.[2] ..... C21C 7/00

[52] U.S. Cl. ..... 75/53; 75/129

[58] Field of Search ..... 75/53, 59, 129

[56] References Cited

U.S. PATENT DOCUMENTS

| | | | |
|---|---|---|---|
| 2,997,386 | 8/1961 | Feichtinger | 75/59 |
| 3,634,075 | 1/1972 | Hoff | 75/53 |
| 3,729,309 | 4/1973 | Kawawg | 75/53 |
| 3,738,827 | 6/1973 | Pryor | 75/53 |
| 3,942,775 | 3/1976 | LaBate | 75/53 |
| 4,057,420 | 11/1977 | Brace | 75/53 |

*Primary Examiner*—P. D. Rosenberg

*Attorney, Agent, or Firm*—Smyth, Pavitt, Siegemund, Jones & Martella

[57] ABSTRACT

Additives in the form of a wire-like object are introduced through a tube into the interior of molten metal bath. The wire in the tube is surrounded by a pressurized gas which prevents metal from entering the tube. Since the tube extends close to the bottom of the bath, the additives melt near that bottom and are distributed in the bath through convective flow.

7 Claims, 1 Drawing Figure

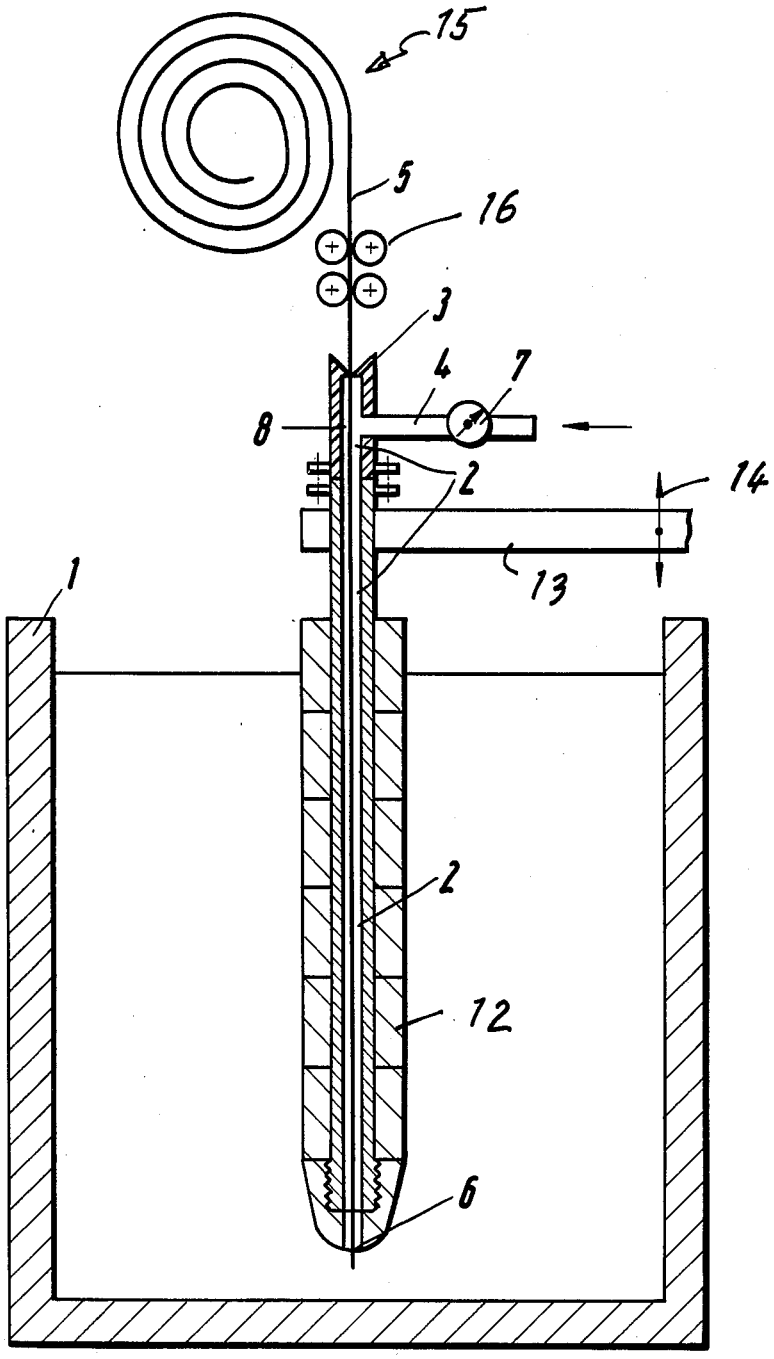
15
5
16
3
4
7
8
2
14
13
1
2
12
6

FEEDING ADDITIVES INTO THE INTERIOR OF MOLTEN METAL

BACKGROUND OF THE INVENTION

The present invention relates to continuously feeding a thin, flexible, wire-like object into a vessel, ladle, distributor, tundish or the like, filled with molten metal, the wire-like object being composed of or at least includes substances to serve as additives in the metal aiding in the process which the molten metal undergoes. The wire-like object envisioned here will in the following be called a wire for the sake of brevity. It is understood, however, that this wire is not necessarily made of metal.

It is known to introduce a covered or sheathed wire as defined into molten metal for purposes of providing additives to the metal. Such a method is, for example, disclosed and described in the German printed patent application No. 1,953,410. The allegation has been made that this particular method permits the controlled adding of an additive, particularly it has been alleged that the speed of adding can be controlled for purposes of introducing the additive deep into the melt. However, the penetration and immersion into deeper levels of the molten material is not controllable, for example, by means of just controlling the speed of feeding the wire into the vessel, simply because the wire material will melt close to the surface of the metal bath no matter how fast the wire is fed. The particular wire-additive, moreover, has to be enveloped in a cover being composed, for example, of a synthetic resin or the like, for purposes of containing the material constituting the "wire" prior to its introduction. That sheath will melt on contact with, possibly even earlier, the top layer of the molten metal. On the other hand, the particular cover must not remain in the molten metal during or even after further treatment thereof.

The German printed patent application No. 2,322,604 describes a method in which a wire-like object as defined is fed into a tundish or the like for purposes of feeding additives to the molten material treated in the equipment of which the tundish is a part. In this particular instance, one passes the wire through a guide tube in order to protect the wire particularly against attacks from the slag layer on top of the molten metal.

It is a decisive disadvantage of this particular method that the material of which the wire is composed will melt in the upper layers of the molten bath no matter what its configuration and speed. Therefore, introduction of these additives into deeper levels of the molten metal requires some kind of agitation of the bath such as stirring or creating turbulence in one form or another. Such agitation, however, poses its own specific disadvantages. One usually wants to have the slag accumulate on the top of the molten material; impurities are removed from the molten metal in that they are accumulated as part of the slag formation on top of the bath. If one now stirs and agitates the bath, these impurities are, at least in parts, flushed back again into the molten material and the purity of the raw melt, of course, deteriorates.

Another method of adding particular substances to molten metal includes, for example, the introduction of powder through a carrier gas. This fluidized powder is introduced by means of a pipe into the bottom portion of the vessel containing the molten metal. It is a decisive disadvantage of that particular method that one has to keep the carrier gas and the powder suspended therein, flowing in a continuing basis; otherwise the tube will fill up with molten metal. In view of the particular ferrostatic fluid pressure static conditions under which the pipe operates, one has very limited control over the amounts of additives that are being fed into a pool of molten metal. Moreover, it was found that the particular tube end easily clogs, terminating or at least severely impeding the flow of the powder plus the carrier gas fluid.

DESCRIPTION OF THE INVENTION

It is an object of the present invention to provide a new and improved method and equipment for introducing additives into a vessel filled with molten metal.

In accordance with the preferred embodiment of the present invention, it is suggested to introduce the additives in form of a wire or the like, running through an isolating gas atmosphere into and through the interior of the molten metal as contained in a vessel, and emerging from the cushion preferably close to the bottom of the vessel. By adjusting the gas pressure of the gas cushion to be about equal or maybe a little larger than the sum of (a) the ferrostatic pressure of the molten metal near the bottom of the vessel, (b) flow losses, and (c) other pressure losses through leakages, one will avoid the introduction of gas into the molten metal or at least no substantial amounts of such gas will enter into and contaminate the metal. The gas cushion is preferably contained (generated and maintained) in a feeder pipe through which the additive in the form of a wire is passed, surrounded in the interior of the tube by the pressurized gas. The main source of any leakage is the point or zone in which the wire is introduced into the tube.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the flowing description taken in connection with the accompanying drawings in which:

The FIGURE is a somewhat schematic, cross sectional view through equipment for practicing the preferred embodiment of the present invention.

Proceeding now to the detailed description of the drawings, the figure shows a ladle, vessel, tundish, or other container 1 filled or to be filled with molten metal for any purpose of processing or intermediate storage of that metal or the like. A feeder tube 2 is disposed for being in parts submerged in the liquid metal; the lower end 6 of the tube terminates close to the bottom of vessel 1. The upper portion of the tube 2 is actually constituted by an entrance chamber 8 which is closed at the top except for a small entrance opening 3, which is just a little larger than the diameter of a wire 5 passing through.

The wire 5 is fed from a suitable store 15 and by suitable conveyer means 16 into the tube 2. A nipple or feeder tube 4 terminates in the entrance chamber 8 and is controlled by means of excess pressure valve 7. This tube 4 is connected to a suitable source of inert gas (e.g. nitrogen) and a valve 7 permits the adjustment of the pressure of that gas as introduced into chamber 8.

The pressure is designed so that the gas pressure in chamber 8 is equal to or a little larger than the static liquid pressure the molten metal exerts upon the interior of the tube 2 at the tube exit 6, plus the pressure drop the gas suffers when flowing from the entrance chamber 8 the outlet 6, plug any pressure drop resulting from leakage generally but including particularly any outflow of gas in the gap between the wire 5 and the entrance 3.

The particular entrance chamber 8 is made exchangeable and displaceable from the tube 2 through bolted connection of suitable flanges to permit a rapid exchange of that particular entrance portion 8, primarily for adapting the entrance part 3 to different diameters of wires 5. The tube 2, particularly a lower portion thereof, is, of course, clad in fireproof, refractory material 12 to afford adequate protection to the tube as such. The tube itself is mounted on a carrier arm 13 and, as indicated by double arrow 14, the arm permits up and down displacement of tube 2, for purposes of controlling the immersion depth of the feed tube 2 and here particularly of the tube opening 6.

It can thus be seen that the inventive method and equipment permits the introduction of additives into and close to the bottom of vessel 1 and by means of a wire-like object 5 whereby particularly the fireproofing serve as an additional thermal insulation of the wire as it is being introduced. The gas atmosphere surrounding the wire in the tube 2 does not only prevent the molten metal from flowing into the interior of the tube but it serves also to some extent as a coolant and thermal insulator so that with certainty the wire 5 and any protective cover it may have does not melt before it is, in fact, introduced into the molten material at the opening 6. As the additives melt, convective currents in the interior of the vessel 1 will suffice to distribute the additive throughout the vessel. An accurate control of the pressure by means of the valve 7 in fact insures that there is fairly little gas flow into the molten metal. It can also be seen, that the rate of feeding wire 5 into the bath has nothing to do with the desired penetration depth, nor does that rate have any bearing on the needed pressure for preventing an influx of molten metal into the tube 2 through opening 6.

Also, very little gas is actually needed because (except in the case of desired vigorous wire cooling) the gas conditions in tube 2 are quasistatic. One needs to replenish only the leakage flow through opening 3. Of course, prevention of entry of metal into tube 2 makes it desirable to establish a local pressure at opening 6 which is to some extent in excess of the fluid-metal pressure.

The invention is not limited to the embodiments described above but all changes and modifications thereof not constituting departures from the spirit and scope of the invention are intended to be included.

We claim:

1. Method of continuous feeding an additive in the configuration of a wire-like, elongated object into a vessel filled with and containing molten metal, comprising steps of:

generating and maintaining an isolating atmosphere of inert gas that leads along a path into the interior of the metal filled vessel, being and remaining separated from the metal but terminating near the bottom of the vessel in contact with the metal thereat; and feeding the wire-like object into the interior of the vessel as surrounded by the gas as maintained so that the wire material contacts the molten metal only upon leaving the gas path deep in the interior of the vessel adjacent to the bottom thereof.

2. Apparatus for continuously feeding an additive in configuration of a wire into a vessel filled with and containing molten metal, comprising:

a tube extending into the vessel and having an opening near the bottom of the vessel, the tube being surrounded by the molten metal;

means for generating and maintaining an isolating atmosphere of an inert gas in said tube that leads into the interior of the metal filled vessel; and means for feeding the wire through the tube into the interior of the vessel and as surrounded by the gas in the tube so that the wire material contacts the molten metal only when leaving the tube through said opening.

3. Apparatus as in claim 2, said means for generating and maintaining including means for feeding the gas into an upper portion of the tube, and at a pressure sufficient to prevent metal from flowing into the tube through said opening.

4. Apparatus as in claim 3 said tube having at its upper end an entrance opening for the wire, being slightly larger than the diameter of the wire but sufficiently small to minimize gas leakage, therefore, being smaller than the diameter of the tube.

5. Apparatus as in claim 4 the tube having an upper and a lower portion, the upper portion including the entrance opening and the gas feed connection being releasibly connected to the lower portion.

6. Apparatus as in claim 3 said tube being jacketed in fireproofing, refractory material.

7. Method as in claim 1, wherein the generating and maintaining step includes maintaining a gas pressure in the isolating atmosphere overcoming the metal pressure in the interior of the vessel to prevent metal from flowing into the isolating atmosphere.

* * * * *